US005548385A

United States Patent [19]

Takai et al.

[11] Patent Number: 5,548,385

[45] Date of Patent: Aug. 20, 1996

[54] DEVELOPER DEVICE THAT GRADUALLY REPLACES DEGRADED DEVELOPER WITH FRESH DEVELOPER

[75] Inventors: Yasuhiro Takai, Sakurai; Atsushi Ueda, Shiki-gun; Hirokazu Tanaka, Osaka; Hideo Yamasa, Ikoma, all of Japan

[73] Assignee: Sharp Kabushiki Kaisha, Osaka, Japan

[21] Appl. No.: 125,317

[22] Filed: Sep. 22, 1993

[30] Foreign Application Priority Data

Feb. 25, 1993 [JP] Japan ..... 5-036466
Jun. 8, 1993 [JP] Japan ..... 5-137620

[51] Int. Cl.[6] ..... G03G 15/06

[52] U.S. Cl. ..... 355/260; 355/246

[58] Field of Search ..... 355/246, 208, 355/245, 298, 253, 251, 260; 118/688–691, 653; 222/DIG. 1

[56] References Cited

U.S. PATENT DOCUMENTS

| | | | |
|---|---|---|---|
| 4,351,604 | 9/1982 | Karasawa et al. | 118/653 X |
| 4,572,102 | 2/1986 | Yuge et al. . | |
| 4,582,415 | 4/1986 | Hyodo et al. | 118/689 X |
| 4,932,356 | 6/1990 | Watanabe et al. . | |
| 5,036,363 | 7/1991 | Iida et al. | 355/246 |
| 5,075,726 | 12/1991 | Itaya et al. | 355/246 |
| 5,095,338 | 3/1992 | Hayes et al. | 355/246 |
| 5,235,391 | 8/1993 | Aimoto | 355/208 X |
| 5,237,373 | 8/1993 | Aimoto et al. | 355/298 |
| 5,260,747 | 11/1993 | Uwagawa et al. | 355/246 |
| 5,310,425 | 5/1994 | Nakagawa et al. | 355/246 X |
| 5,430,532 | 7/1995 | Ueda et al. | 355/260 |
| 5,450,178 | 9/1995 | Kawashima et al. | 355/260 |

FOREIGN PATENT DOCUMENTS

| | | |
|---|---|---|
| 0525706 | 2/1993 | European Pat. Off. . |
| 55-028082 | 2/1980 | Japan . |
| 59-100471 | 6/1984 | Japan . |
| 62-066283 | 3/1987 | Japan . |
| 2-21591 | 5/1990 | Japan . |
| 4-118675 | 4/1992 | Japan . |

*Primary Examiner*—Arthur T. Grimley
*Assistant Examiner*—Shuk Y. Lee
*Attorney, Agent, or Firm*—David G. Conlin; Brian L. Michaelis

[57] ABSTRACT

A developer device is provided with a developer vessel for storing therein a developer material composed of toner particles and carrier granules. In the developer device, a target ratio of toner particles for a detected quantity of the developer material is computed. In the device, a toner concentration detector sensor is also provided for detecting the ratio of toner particles in the developer vessel. In order to set the detected toner ratio of toner particles equal to the target ratio, quantity of toner particles to be additionally supplied to the developer vessel is controlled. As a result, the ratio of toner particles to the developer material stored in the developer vessel can be maintained in a predetermined ratio, thereby ensuring a desirable image quality.

20 Claims, 13 Drawing Sheets

DEVELOPER DEVICE THAT GRADUALLY REPLACES DEGRADED DEVELOPER WITH FRESH DEVELOPER

FIELD OF THE INVENTION

The present invention relates to a developer device for supplying toner particles to the surface of a photoreceptor, to be provided in an electrophotographic printing machine such as a copying machine, the developer device storing therein a developer material composed of toner particles and carrier granules for use in developing an electrostatic latent image formed on the surface of the photoreceptor.

BACKGROUND OF THE INVENTION

Developer devices for visualizing (developing) an electrostatic latent image formed on the surface of a photoreceptor using a developer material composed of carrier granules and toner particles are used, for example, in many dry-type copying machines. In such developer devices, the quantity of the toner particles is reduced while being used in the developing process; whereas, the quantity of carrier granules in the developer material remains the same. Therefore, the quality of the carrier granules being stirred with toner particles in the developer material deteriorates because a resin coating layer on the surface thereof is peeled, or toner particles adhere onto the surface thereof. As a result, the charging ability of the developer material gradually deteriorates.

The device which prevents the deterioration of the charging ability by supplying additional carrier granules separately from the refill for the used toner particles has been disclosed (see, for example, Japanese Laid-Open Patent Application No. 21591/1990 (Tokukouhei 2-21591)). In such a device, when adding additional carrier granules, excessive developer material in the developer vessel is discharged through a discharge opening formed on the wall of the developer vessel to be collected in a waste container. By repeating the above refill and discharge of the developer material, the developer material in the developer vessel whose charging ability has deteriorated can gradually replace. Thus, the required charging ability of the developer material can be restored, and the deterioration in the copied image quality can be prevented.

However, when the carrier granules are additionally supplied to the developer material little by little, the quantity of developer material in the developer vessel is likely to change, and thus the ratio of toner particles to the developer material cannot be accurately controlled. Therefore, the above device presents the problem that it is difficult to ensure a desirable image quality.

In the above device, additional toner particles are supplied by detecting the ratio of toner particles in the developer vessel, for example, using the toner concentration sensor composed of a magnetic permeability sensor. In the case where carrier granules remain in the developer material without being additionally supplied nor discharged, the quantity of the developer material will not change much because only the quantity of toner particles changes. Therefore, using the toner concentration sensor provided at the position in contact with the developer material, the ratio of the toner particles to the developer material can be accurately controlled.

On the other hand, in the case where carrier granules are additionally supplied to the developer material to gradually replace the carrier granules whose quality has deteriorated, there i a greater change in the quantity of the developer material between directly after the supply of carrier granules and directly after the discharge of the developer material compared with the above case where carrier granules are not additionally supplied. Especially in the case of a portable type compact copying machine, due to an impact or tilt when moving, a large quantity of developer material may be discharged through the discharge opening at one time. Therefore, a constant quantity of the developer material in the developer vessel is difficult to maintain.

Furthermore, because the quantity of developer material in the developer vessel is not always constant, the ratio of toner particles in the developer vessel cannot be accurately controlled by the magnetic permeability sensor provided in the developer vessel.

In the above developer device, an attempt has not been made to accurately detect the ratio of toner particles to the developer material in the developer vessel by the toner concentration sensor. Therefore, in the case where the toner concentration sensor is merely provided so as to be in contact with the developer material as in the case of the conventional model, the ratio of the toner particles to the developer material in the developer vessel may vary greatly in the vicinity of the toner concentration sensor due to a change in the quantity of the developer material. Specifically, when the concentration of the developer material in the vicinity of the toner concentration sensor is high, additional toner particles may not be supplied, thereby presenting the problem that the sufficient quantity of toner particles may not be ensured. On the other hand, when the concentration of the developer material is low, toner particles may be supplied excessively, thereby presenting the problem that the ratio of toner particles to the developer material becomes too high. In the above cases, because a copying operation cannot be carried out with an appropriate ratio of the toner particles, the image quality may deteriorate.

Another type of developer device has been proposed wherein the toner concentration sensor is provided on the bottom wall of the developer vessel. However, the above device also presents the problem that the ratio of the toner particles to the developer material may not be detected accurately. For example, in the case where the toner concentration sensor is provided on the bottom wall under the developer roller, in the position where carrier granules are moved thereto after supplying toner particles onto the photoreceptor for the developing process, the ratio of the toner particles in the developer material tends to be low. Thus, it is difficult to detect the average ratio of the toner particles in the developer material stored in the developer vessel. Moreover, depending on the structure of the developer vessel, in the case where the toner concentration sensor is provided on the bottom wall, the toner concentration sensor may not be always in stable contact with the developer material. Therefore, the above arrangement also fails to overcome the problems raised in conventional models.

SUMMARY OF THE INVENTION

An object of the present invention is to provide a developer device which permits the ratio of toner particles to a developer material stored in a developer vessel to be accurately detected, and which permits an additional toner particles to be supplied in an appropriate quantity for the quantity of the developer material, thereby ensuring a desirable image quality.

In order to achieve the above object, the developer device of the present invention includes: a developer vessel for storing therein a developer material including toner particles; toner concentration detection means for detecting the ratio of toner particles in the developer vessel (a magnetic permeability sensor, etc.); toner particle supply means for supplying additional toner particles to the developer vessel; developer material quantity detection means for detecting the quantity of the developer material in the developer vessel; and control means for computing a target ratio of toner particles based on the detected quantity of the developer material and for controlling the quantity of toner particles to be additionally supplied from the toner particle supply means so that the detected ratio of toner particles equals the target ratio.

In the above arrangement, the quantity of the developer material in the developer vessel is detected by the developer material quantity detection means, and a target ratio of toner particle for the detected quantity of developer material is computed by the control means. Then, the control means controls the quantity of toner particles to be additionally supplied from the toner particle supply means so that the toner concentration detected by the toner concentration detection means equals the target ratio of toner particles. As a result, a constant ratio of the toner particles in the developer material stored in the developer vessel can be maintained.

Additionally, the developer material quantity detection means may be provided in a height direction of the developer material in the developer vessel so as to be composed of means for detecting the height of the developer material in the developer vessel (for example, an optical detector composed of a light emitting element and a light receiving element).

The toner concentration detection means is preferably placed in the vicinity under a discharge section formed in the developer vessel. In the above arrangement, sufficient quantity of developer material can be ensured in the vicinity under the discharge section from which an excessive developer material is discharged to be removed out of the developer vessel. Moreover, in the developer vessel, whenever an excessive developer material is discharged through the discharge opening, there is a flow of the developer material towards the discharge opening. Therefore, even before and after an excessive developer material is discharged, a predetermined quantity of the developer material can be always ensured in the vicinity under the discharge opening. As described, when the toner concentration detection means is provided in the vicinity under the discharge opening, the developer material can be always in stable contract with the toner concentration detection means. Thus, a change in the ratio of toner particles to the developer material in the vicinity under the discharge opening is not likely to occur, and the ratio of the toner particles to the developer material can be accurately detected by the toner concentration detection means. For example, in the case where the developer material of the present invention is adopted in a copying machine, when moving the copying machine, a large quantity of developer material may be discharged from the developer vessel due to an impact or tilt when moving the copying machine. Even if the above event occurs, because the developer material surely exists in the position where the toner concentration sensor is provided, the toner particles in the developer vessel can be controlled in an appropriate ratio, thereby ensuring a desirable image.

Additionally, a developer material path for flowing therethrough a developer material is preferably provided in the bottom portion of the developer vessel. Furthermore, the toner concentration detection means is preferably provided along the path. In the above arrangement, in the path provided in the bottom portion of the developer vessel, for flowing therethrough a developer material, a predetermined quantity of developer material is ensured even directly before and after the discharge of the developer material. Moreover, even if a large quantity of developer material is discharged from the developer vessel, the developer material flows thereto. Therefore, the toner concentration detection means is always in stable contact with the developer material, and thus the ratio of the toner particles can be accurately detected by the toner concentration detection means provided in the developer material path. As a result, the toner particles in the developer vessel can be controlled in an appropriate ratio, thereby ensuring a desirable image quality.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention.

DESCRIPTION OF THE EMBODIMENTS

The following description will discuss one embodiment of the present invention in reference to FIGS. 1 through 17.

Figure 2:
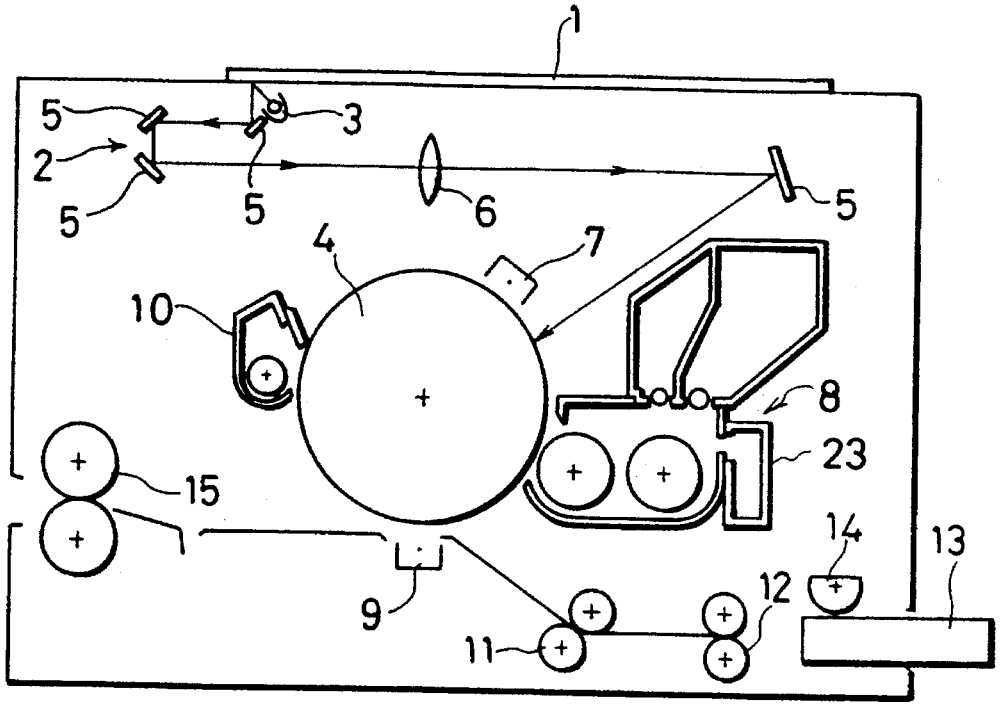
FIG. 2 is an explanatory view showing an entire configuration of a copying machine wherein the developer device of FIG. 1 is provided.

As shown in FIG. 2, a copying machine provided with a developer device of the present invention includes a document platen 1 provided on the upper surface thereof, and an exposure-use optical system 2 provided under the document platen 1. The optical system 2 is composed of a light source lamp 3 for scanning the document (not shown) placed on the document platen 1 while projecting light, a plurality of reflective mirrors 5 for directing light reflected from the document to a photoreceptor 4, and a lens unit 6 provided along an optical path of the reflected light.

Along the circumference of the photoreceptor 4, the following units are provided: a charger 7 for charging the surface thereof to a predetermined potential; an eraser (not shown); a developer device 8 for developing an electrostatic latent image formed on the surface of the photoreceptor 4; a transfer charger 9 for transferring a toner image on the surface of the photoreceptor 4 to a sheet; a cleaning unit 10 for collecting toner particles remaining on the surface of the photoreceptor 4; and a remover (not shown) are provided. On the sheet entry side of the photoreceptor 4, a timing roller 11 for feeding sheets at a predetermined timing, a transport roller 12, a feed cassette 13, and a feed roller 14 are provided. On the other hand, on the sheet discharge side of the photoreceptor 4, a fuser 15 for making a toner image transferred onto a sheet permanently affixed thereto.

Figure 1:
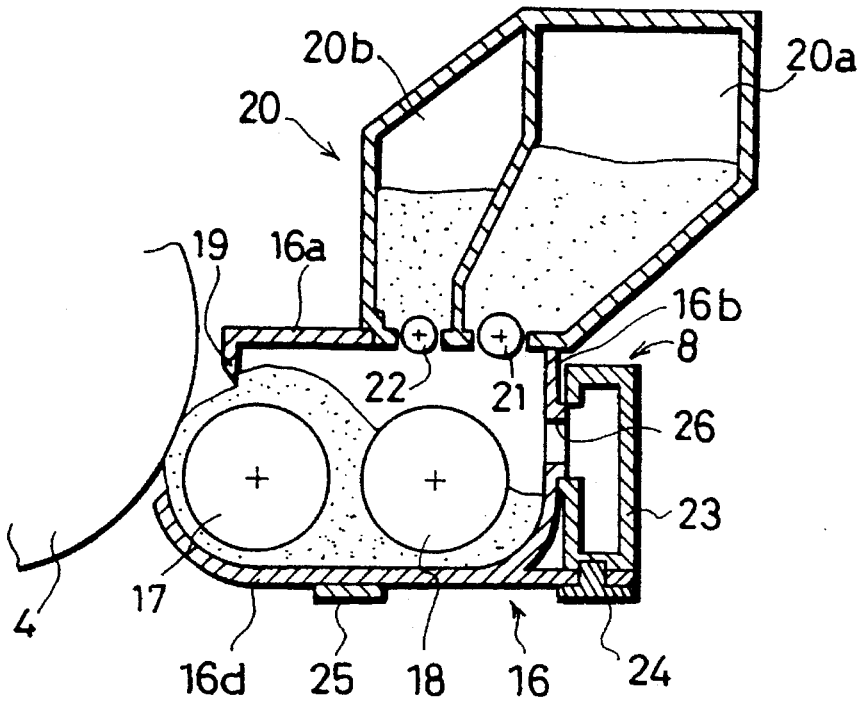
FIG. 1 which shows one embodiment of the present invention is an enlarged cross-sectional view showing a developer device provided in a copying machine.

As shown in FIG. 1, the developer device 8 includes an enclosed developer vessel 16. Further, a developer roller 17 composed of a magnet roller and a stirring roller 18 are rotatably provided in the developer vessel 16. The developer material stored in the developer vessel 16 is composed of carrier granules and toner particles. The carrier granules which are composed of magnetic substances include a resin coating layer formed on the surface thereof for controlling the adherence of toner particles. When carrier granules and the toner particles are mixed by the stirring roller 18, the toner particles are electrically charged by friction. The developer roller 17 attracts carrier granules, and carries them by a magnetic brush. Thus, the toner particles adhering onto carrier granules by Coulomb force adhere onto the electrostatic latent image on the photoreceptor 4, thereby developing the electrostatic latent image. Here, the length of the magnetic brush is controlled by a doctor 19.

Further, an entry opening for additional developer material is formed on a ceiling 16*a* of the developer vessel 16. A developer material feed unit 20 is set from above the opening so as to fit thereto. Inside the developer material feed unit 20 is divided into two compartments: a toner particle storing compartment 20*a* (toner supply section) and a carrier developer storing compartment 20*b* (carrier supply section). In the toner particle storing compartment 20*a*, toner particles are stored, and in the carrier developer storing compartment 20*b*, a developer material composed only of carrier granules or a developer material composed of toner particles and carrier granules in a predetermined ratio (hereinafter referred to as a carrier developer) is stored.

On the respective bottoms of storing compartments 20*a* and 20*b*, toner supply roller 21 and a carrier developer supply roller 22 are provided. By the rotations of the toner supply roller 21, the toner particles in the toner particle storing compartment 20*a* drop into the developer vessel 16 according to the driving time of the roller 21. Similarly, by the rotations of the carrier developer supply roller 22, the carrier granules in the carrier developer storing compartment 20*b* drop into the developer vessel 16 according to the driving time of the roller 22.

On the side wall 16*b* of the developer vessel 16, an enclosed waste container 23 (developer material collecting section) with an opening on the side thereof is removably secured. In the developer vessel 16, an entry opening is formed on the side wall 16*b*. Further, a discharge opening 26 (discharge section) for connecting the developer vessel 16 and the waste container 23 is formed on the side wall 16*b*. The discharge opening 26 side of the bottom 16*d* of the developer vessel 16, a projecting plate 16*c* (see FIG. 4) for supporting the waste container 23 is formed. A magnetic permeability sensor 24 for detecting the quantity of the developer material in the waste container 23 is provided on the projecting plate 16*c*.

Figure 3:
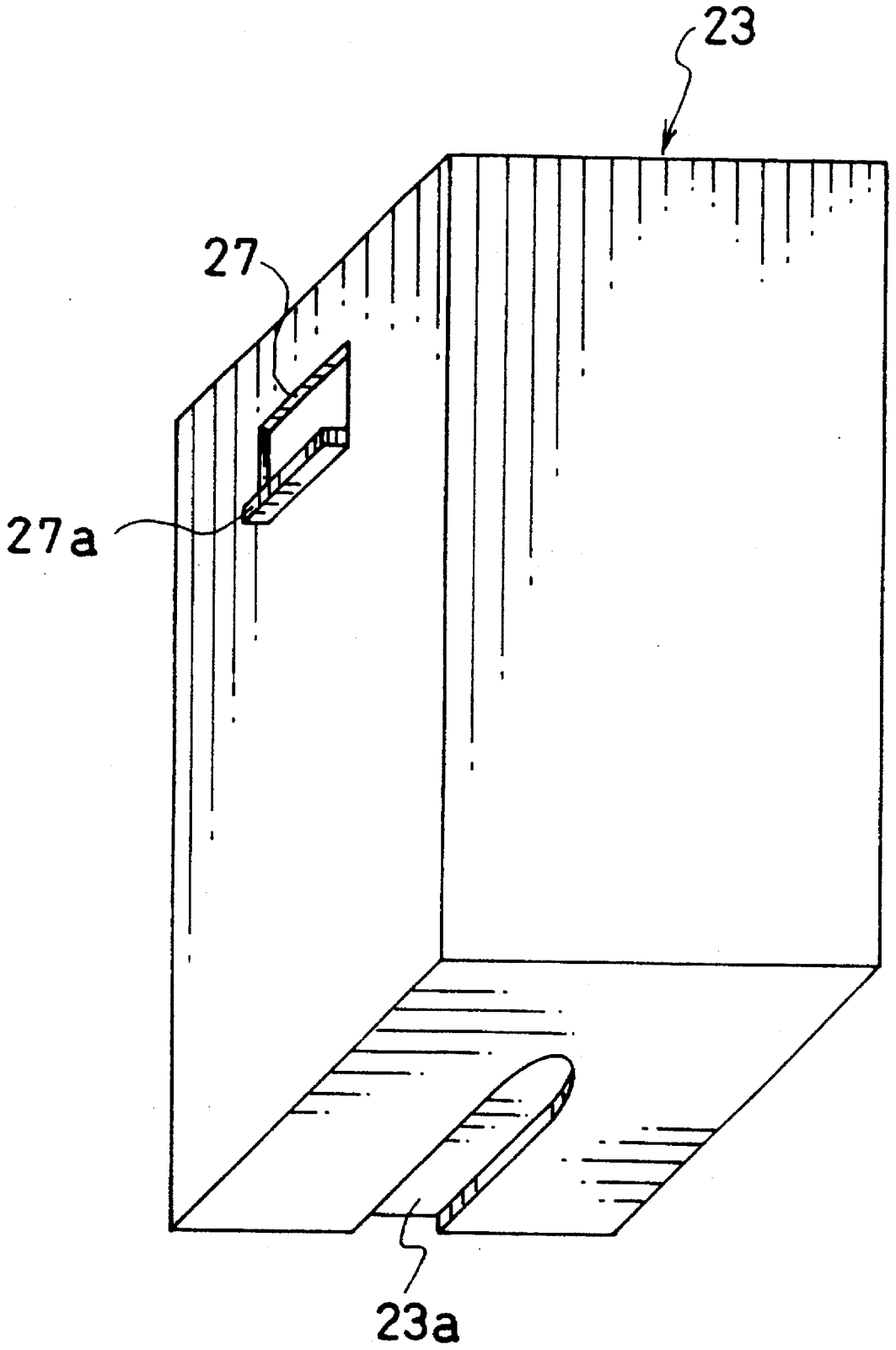
FIG. 3 is a perspective view showing a waste container.
Figure 4:
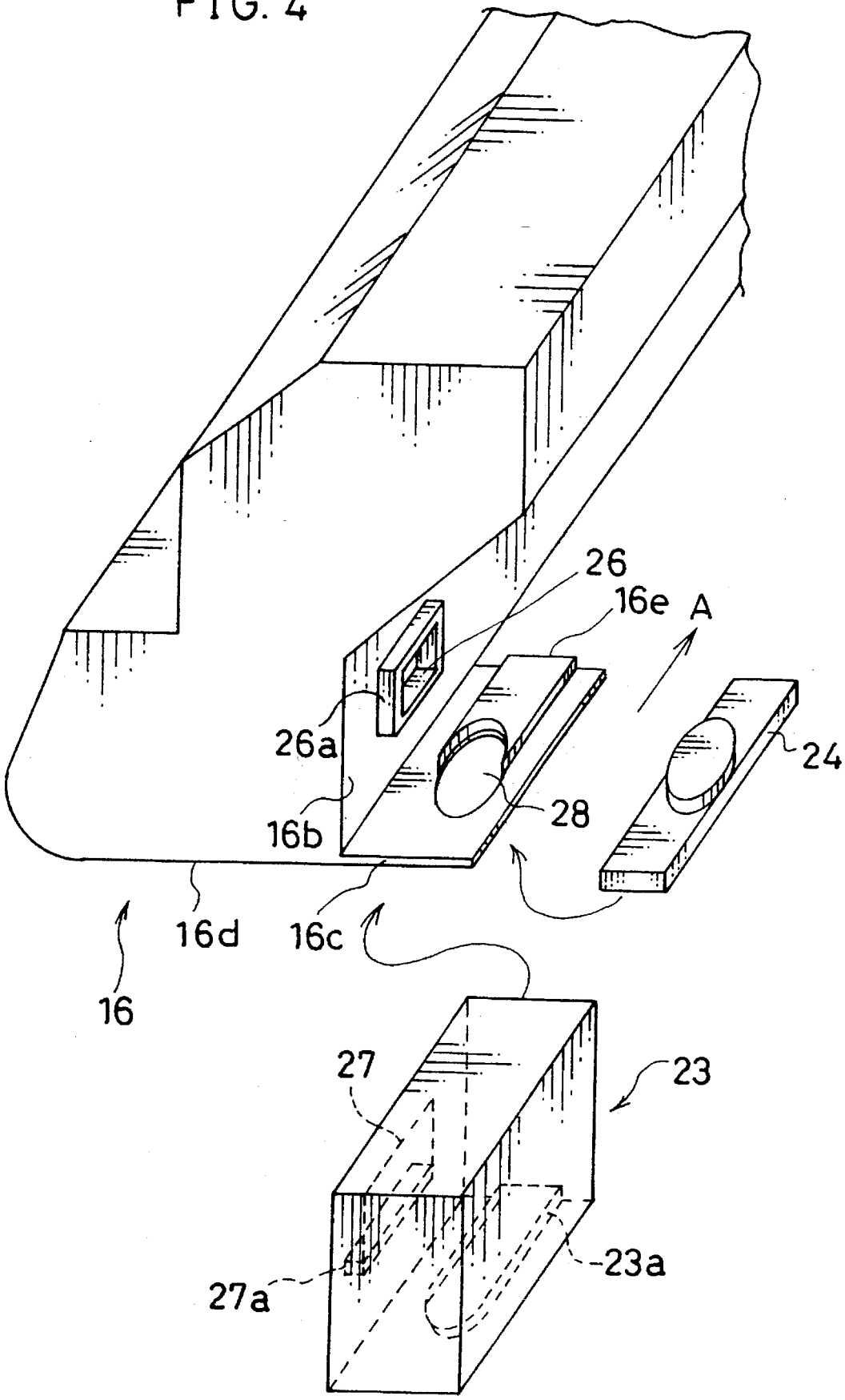
FIG. 4 is an explanatory view showing how the waste container is installed in the developer device.

As shown in FIGS. 3 and 4, a collection-use opening 27 is formed on the side wall of the waste container 23 so as to communicate with the discharge opening 26 of the developer vessel 16. Further, a projected portion 27*a* is formed under the opening 27 for preventing the developer material from spilling. On the bottom of the waste container 23, a recessed portion 23*a* is formed so as to accommodate the waste container 23 with the projected portion 16*e* formed on the bottom 16*d* of the developer vessel 16. Further, a hole 28 is formed so as to install the magnetic permeability sensor 24 on the bottom 16*d* of the developer vessel 16. The magnetic permeability sensor 24 is provided for measuring the magnetic permeability of carrier granules. Thus, the magnetic permeability sensor 24 is not required to be in contact with the developer material, and it is only required to be in tight contact with the waste container 23.

When installing the waste container 23 to the developer vessel 16, the waste container 23 slides in the direction of arrow A (see FIG. 4) so as to accommodate the recessed portion 23*a* of the waste container 23 with the projected portion 16*e* of the developer vessel 16. In this arrangement, the projected portion 27*a* is installed so as to be in contact with the bottom of the projected portion 26*a* which is formed so as to surround the discharge opening 26, and the collection-use opening 27 and the discharge opening 26 of the developer vessel 16 are horizontally connected.

Another example of the waste container 23 will be explained with reference to FIG. 13 through FIGS. 15(*a*) and (*b*). Additionally, members having the same functions as the aforementioned members will be designated by the same codes. Thus, the descriptions thereof shall be omitted here.

Figure 13:
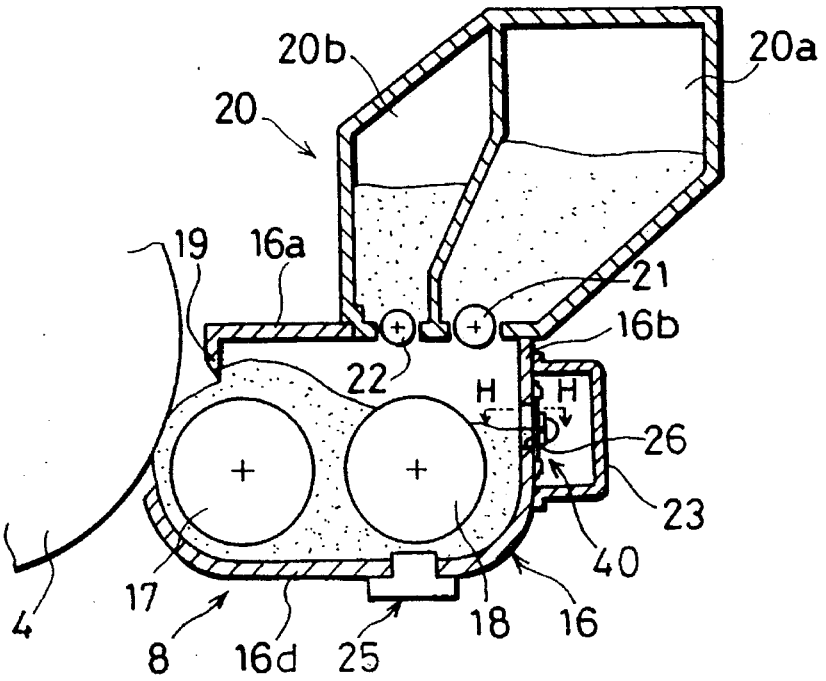
FIG. 13 which shows another embodiment of the present invention is an enlarged cross-sectional view showing the developer device provided in the copying machine.
Figure 14:
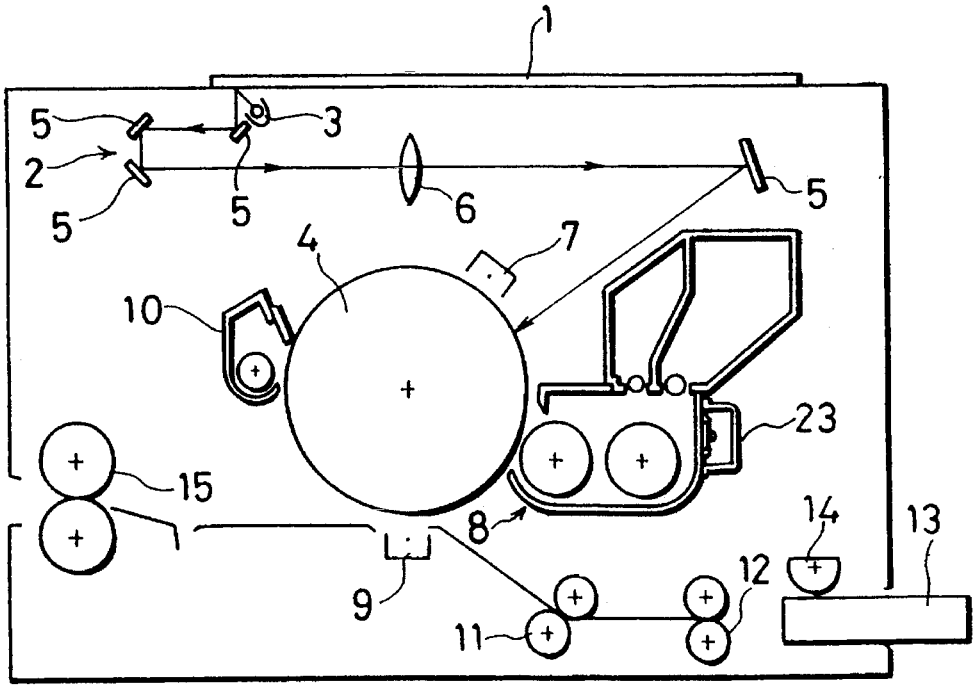
FIG. 14 is a typical depiction showing an entire configuration of a copying machine wherein the developer device is provided.

The waste container 23, which has a shape shown in FIG. 13, is provided within the developer device 8 (see FIG. 14). Namely, on the side wall 16*b* of the developer vessel 16, the enclosed waste container 23 with an opening formed on the side thereof is removably secured. Further, the discharge opening 26 for communicating the developer vessel 16 with the waste container 23 is formed on the side wall 16*b*. An opening and closing mechanism 40 for opening and closing the discharge opening. 26 is provided along the outer surface of the side wall 16*b*.

Figure 15:
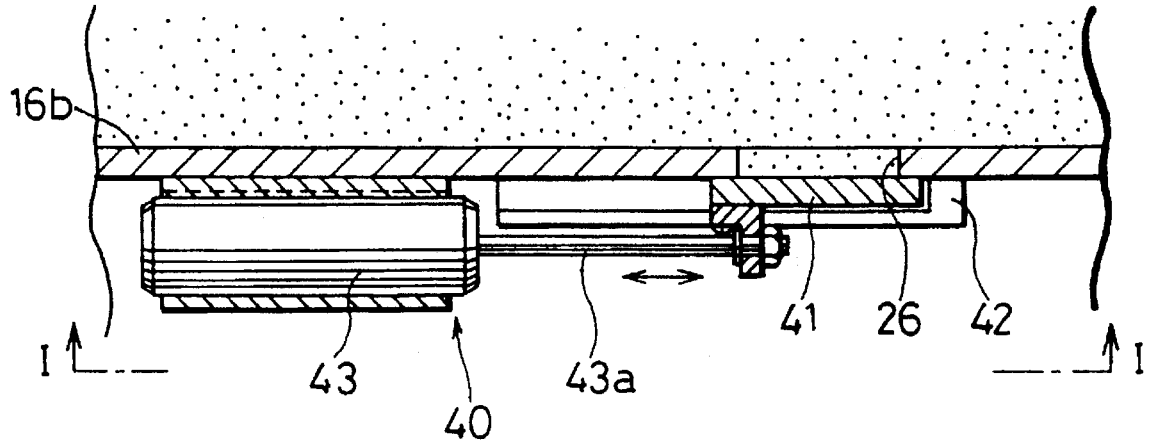
FIGS. 15 (*a*) and (*b*) are views showing essential parts of the developer device wherein FIG. 15(*a*) is a cross-sectional view taken on the line H—H of FIG. 13 and FIG. 15(*b*) is a plan view taken on the line I—I of FIG. 15(*a*)
Figure 15:
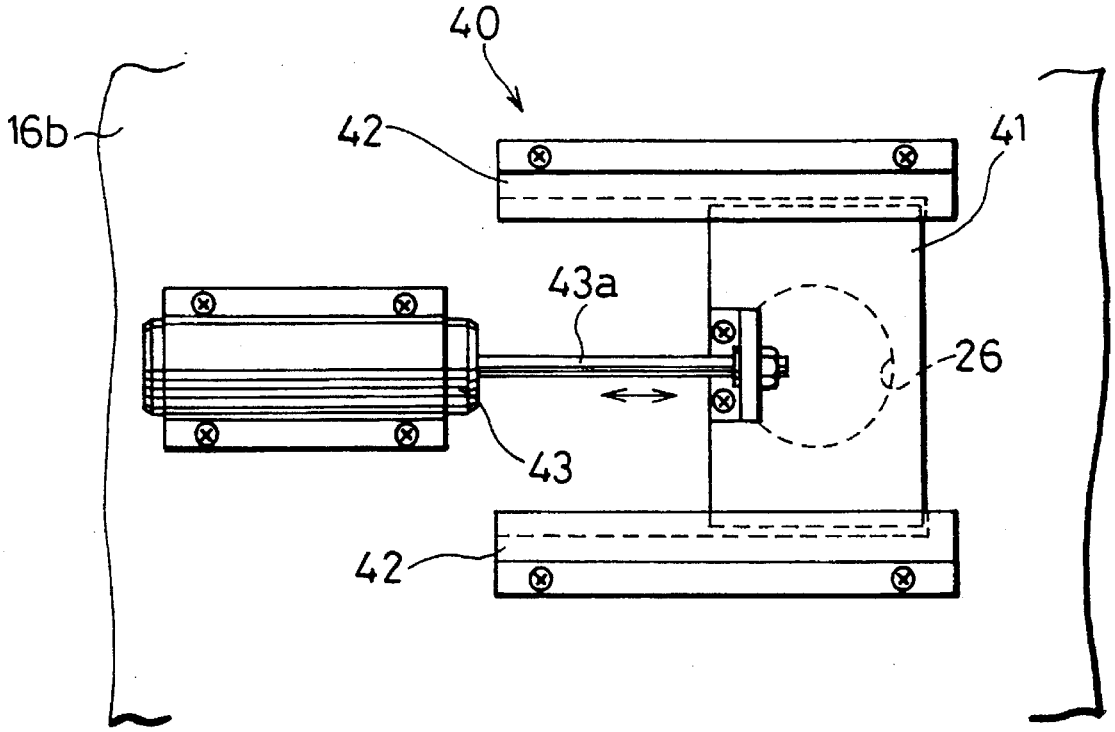

As shown in FIGS. 15(*a*) and (*b*), the opening and closing mechanism 40 is composed of a flat plate shaped opening and closing cover 41 provided so as to be capable of freely sliding along the outer surface of the side wall 16*b*, a pair of guide plates 42 provided on both sides of the opening and closing cover 41 so as to guide the sliding of the opening and closing cover 41, and a discharge-use solenoid 43 with an end of a plunger 43a thereof being connected to the opening and closing cover 41.

Figure 16:
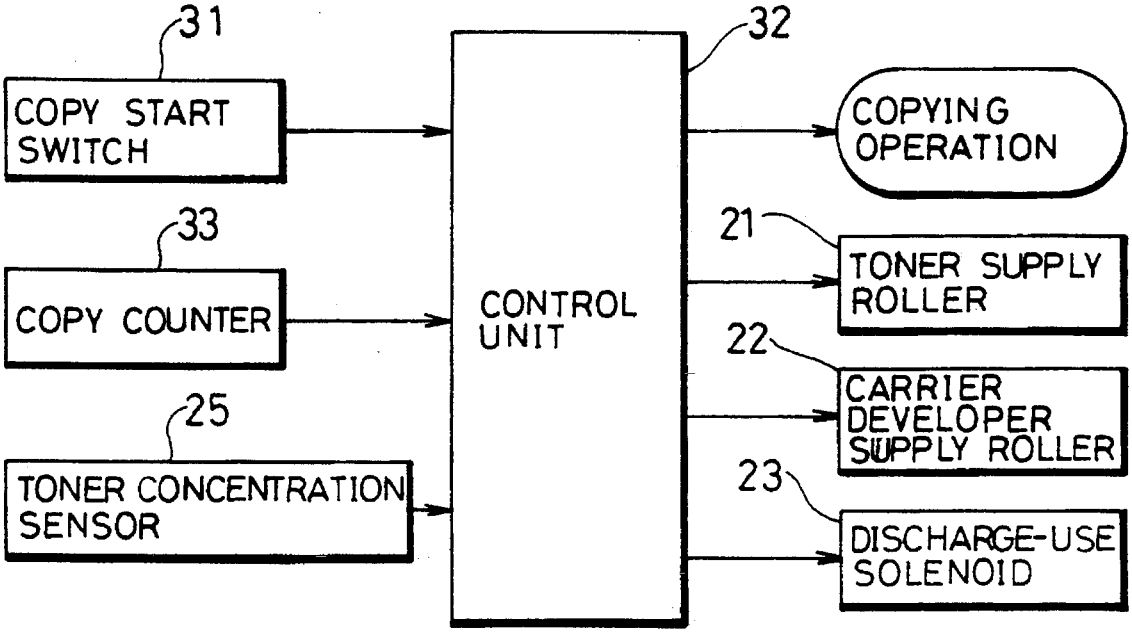
FIG. 16 is a block diagram showing a controlling system of the copying machine.

As shown in FIG. 16, the control unit 32 composed of a microcomputer is provided in a copying machine main body. A signal is outputted from the control unit 32 for controlling the discharge-use solenoid 43. For example, when the discharge-use solenoid 43 is set OFF, the plunger 43*a* is held at a forward position, and the opening and closing cover 41 is thus held in a closed position so as to cover the discharge opening 26. On the other hand, when the discharge-use solenoid 43 is set ON, the plunger 43*a* moves backward. As a result, the opening and closing cover 41 is retreated from the position where the discharge opening 26 is covered, and the discharge opening 26 is set open. In the open state, the developer material in the developer vessel 16 drops through the discharge opening 26 into the waste container 23 to be removed from the developer vessel 16.

The copying processes in the copying machine having the above arrangement will be explained below.

When a power switch (not shown) is turned ON, first, warming up processes are carried out. After completing the warming up processes, a copy start switch 31 is turned ON. Then, a document placed on the document platen 1 is scanned by an optical source lamp 3 of the exposure optical system 2. Here, the light reflected from the document is projected onto the photoreceptor 4 through the reflecting mirror 5 and the lens unit 6. As a result, an electrostatic latent image is formed on the surface of the photoreceptor 4 which is charged to a predetermined potential by the charger 7. Then, the electrostatic latent image is developed using toner particles supplied from the developer device 8. The toner image on the surface of the photoreceptor 4 is transferred onto a sheet fed from the feed cassette 13 by the transfer charger 9. Then, the toner image is made permanent on the copying material by the fuser 15. As a result, the copy image corresponding to the document image on the sheet is formed.

Figure 5:
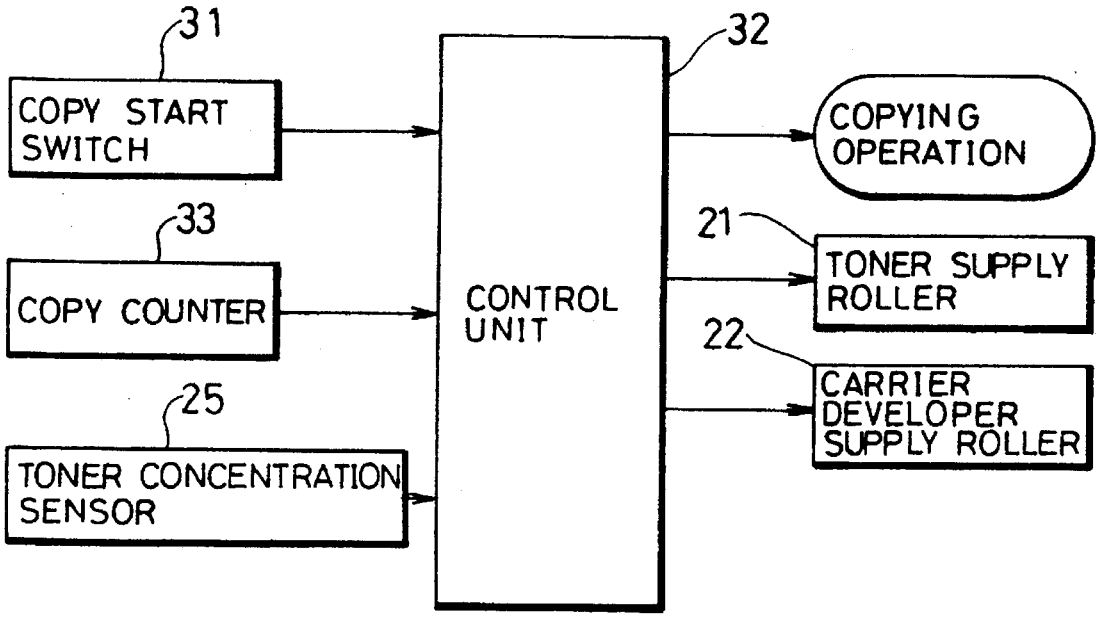
FIG. 5 is a block diagram showing a controlling system of the copying machine.

In order to control the above sequential copying processes, the control unit 32 composed of a microcomputer is provided in the copying machine as shown in FIG. 5. The control unit 32 is arranged so that a signal for turning ON the copy start switch 31 is inputted thereto. Further, a counter 33 is provided for counting the accumulated number of copies, and a count value (hereinafter referred to as a copy count value) n is inputted into the control unit 32.

By repeating the above copying processes, the toner particles in the developer material stored in the developer vessel 16 of the developer device 8 are gradually used, and the ratio of the toner particles to the developer material drops accordingly. Here, because the toner concentration sensor 25 is provided in the developer vessel 16 for detecting a change in the ratio of toner particles, the toner supply roller 21 is activated under the control of the control unit 32 based on the toner concentration sensor 25.

When it is detected that the ratio of the toner particles in the developer vessel 16 drops below the range of an appropriate ratio for developing by the detection signal from the toner concentration sensor 25, the toner supply roller 21 is activated. As a result, toner particles are supplied into the developer vessel 16 from the toner particle storing compartment 20*a*. By additionally supplying the toner particles, the ratio of the toner particles to the developer material gradually increases, and when it is detected that the ratio exceeds the range appropriate for developing, the toner supply roller 21 is stopped. With the above control, the ratio of toner particles in the developer vessel 16 can be maintained within the range appropriate for the developing process. In this example, the toner concentration sensor 25 is provided under the bottom 16*d* of the developer vessel 16 in the vicinity under the discharge opening 26.

Additionally, the method for supplying additional toner particles is not limited to the above method. For example, a toner concentration control method (to be described later) wherein toner particles are supplied using an output value from the toner concentration sensor 25 may be used as well.

As described, additionally supplied toner particles are mixed with the developer material in the developer vessel 16, and after controlling the developer material to a predetermined charge, it is supplied onto the photoreceptor 4 for developing. On the other hand, the quality of the carrier granules in the developer material gradually deteriorates as being repeatedly used while being stirred by the developer roller 17 and the stirring roller 18, or by contacting the surface of the photoreceptor 4. If the quality of the carrier granules deteriorates, a predetermined charge of toner particles may not be ensured, thereby reducing an image quality. In order to prevent the above problem, an attempt has been made to prevent the reduction in the quality of an image by supplying not only toner particles but also carrier granules so as to gradually replace the carrier granules in the developer vessel 16 which has deteriorated. In order to supply carrier granules, the control unit 32 also controls the supply of carrier granules from the carrier developer storing compartment 20*b*. The control of the supply and discharge is carried out at the same timing or at different timings, for example in every predetermined copy count value n.

As described, in the developer device 8 of the present embodiment, the toner concentration sensor 25 is provided at the bottom 16*d* in the vicinity of the discharge opening 26 formed on the side wall 16*b*. Using the toner concentration sensor 25, the ratio of the toner particles in the developer vessel 16 can be accurately detected.

A predetermined quantity of toner particles can be ensured in the vicinity under the discharge opening 26 provided for discharging therethrough excessive developer material. Furthermore, whenever a predetermined quantity of developer material is discharged through the discharge opening 26, the developer material flows into the discharge opening 26. Therefore, even directly before and after the discharge of the developer material, a predetermined quantity of the developer material can be ensured in the vicinity under the discharge opening 26. Therefore, the toner concentration sensor 25 is in stable contact with the developer material. Thus, the concentration of the developer material is not likely to vary at the portion, and thus it can be detected by the toner concentration sensor 25 under the same condition. As a result, the ratio of toner particles can be accurately detected. In this arrangement, even if a large quantity of developer material is discharged from the developer vessel 16 due to an impact or tilt when moving the copying machine provided with the developer device 8 of the present invention, a predetermined quantity of the developer material can be ensured at the position where the toner concentration sensor 25 is provided. As a result, an appropriate ratio of toner particles can be maintained in the developer vessel 16, thereby ensuring a desirable image quality.

As described, the developer device includes the toner concentration sensor for detecting the ratio of toner particles in the developer vessel, which is provided in the vicinity under the discharge section of the developer vessel for discharging excessive developer material. Therefore, the toner concentration sensor can be always in stable contact with the developer material under the same condition. This prevents the concentration of the developer material in the vicinity of the toner concentration sensor from greatly varying, thereby ensuring an accurate detection of the ratio of toner particles by the toner concentration sensor. As a result, the toner particles in the developer vessel can be always maintained in a desirable ratio, thereby ensuring a desirable image quality.

Figure 17:
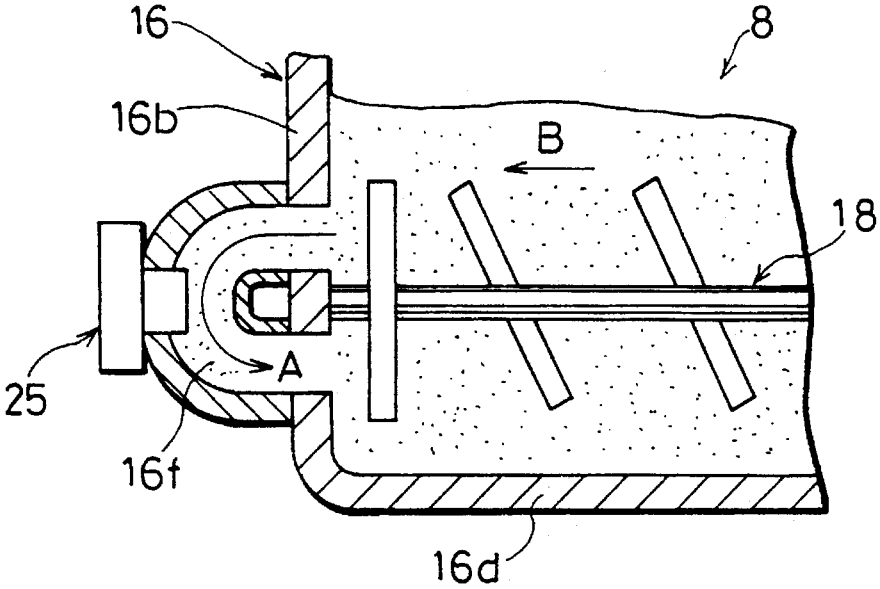
FIG. 17 which shows another embodiment of the present invention is a longitudinal cross-sectional view of a developer device.

Another method for accurately detecting the ratio of toner particles in the developer vessel 16 will be explained in reference to FIG. 17. For the sake of convenience, members having the same functions as in the aforementioned embodiment will be designated by the same code and their description will be omitted.

In this example, a developer material path 16*f* is provided in an axial direction of the stirring roller 18 provided on the side wall 16*b* of the developer vessel 16, and the toner concentration sensor 25 is provided on the wall of the developer material path 16*f*. The upper end portion of the developer material path 16*f* communicates with the portion of the developer vessel in the vicinity of one end in an axial direction of the stirring roller 18 which carries the developer material in the direction of arrow B. On the other hand, the lower end portion of the developer material path 16*f* communicates with the portion of the developer vessel where the developer material always flows and certainly exists. In this arrangement, the developer material flows in the direction of arrow A through the developer material path 16*f*. Other than the above, the developer device of this example has the same arrangement as the developer device of the previous example.

According to the above arrangement, more than a predetermined quantity of the developer material exists in the developer material path 16*f*, and thus the toner concentration sensor 25 can be always in stable contact with the developer material. Therefore, the constant concentration of the developer material at the portion can be maintained. As a result, the ratio of toner particles can be accurately detected by the toner concentration sensor 25 under the same condition. Moreover, even if a large quantity of developer material is discharged from the developer vessel 16 at one time due to an impact or tilt when moving the copying machine provided with the developer device 8 of the present invention, the developer material can be ensured in the position where the toner concentration sensor 25 is provided. As a result, an appropriate ratio of toner particles can be restored in the developer vessel 16, thereby ensuring a desirable image quality.

It should be noted here that although the developer material path 16*f* is formed so as to be projected from the main body of the developer vessel 16 in the above example, the present invention is not limited to this arrangement. For example, the developer material path 16*f* can be formed in an inner portion of the developer vessel 16 as long as the toner concentration sensor 25 is in stable contact with the developer material.

As described, the developer device of the present example is arranged such that the developer material path for flowing therethrough a developer material in the developer vessel is formed at the bottom portion of the developer vessel, and the toner concentration sensor for detecting the toner concentration is provided in the developer material path. In this arrangement, the toner concentration sensor can always be in stable contact with the developer material. Therefore, the ratio of toner particles in the developer vessel 16 can be accurately detected. As a result, an appropriate ratio of toner particles can be maintained in the developer vessel, thereby ensuring a desirable image quality.

Figure 6:
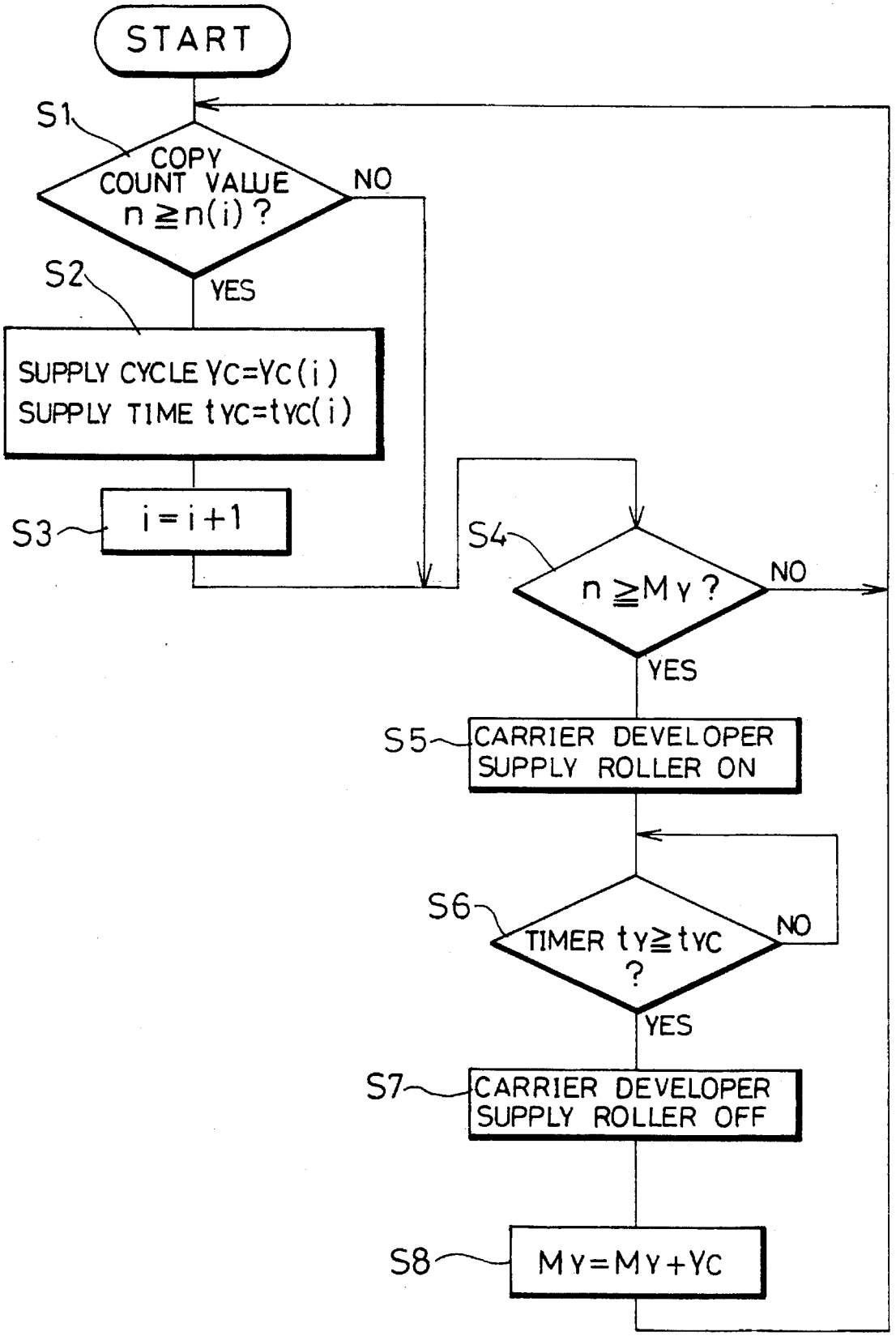
FIG. 6 is a flow chart showing processes for supplying additional carrier developer to the developing vessel.

In reference to FIG. 6, another method of controlling the quantity of additional carrier developer to be supplied by the control unit 32 will be explained.

The respective values for a supply cycle $Y_C$ and a supply time $T_{YC}$ are set according to an accumulated number of copies. Every time a copying operation is carried out, a copy count value n of the copy counter 33 compares with the set value switching count value n(i) (S1). A plurality of values are stored in a memory in the control unit 32 so as to correspond to n(1), n(2), . . . , and the stored values are read out in response to a parameter i in S1. In the memory, the supply cycle value $Y_C$ (i) and supply time $t_{YC}$(i) are stored corresponding to each of set value switching count value n(i) (i=1,2, . . . ).

In S1, when it is determined that the copy count value n reaches set value switching count value n(i), $Y_C$(i) and $t_{YC}$(i) respectively corresponding to n(i) at this time are set as supply cycle $Y_C$ and the supply time $t_{YC}$ to replace old values (S2). Thereafter, the parameter increases by 1 (S3).

After carrying out the above processes S1–S3 for renewing the values, the copy count value n is compared with a supply timing value $M_Y$ (S4). If n has not reached $M_Y$, the sequence goes back to S1. On the other hand, if n has reached $M_Y$, the carrier developer supply roller 22 is set ON (S5). As a result, the supply of carrier developer is started from the carrier developer storing compartment 20*b* to the developer vessel 16. Simultaneously, the timer for watching the supply time starts counting (S6). When the time elapsed $t_Y$ counted by the timer reaches the supply time $t_{YC}$, the supply of additional carrier developer is stopped by turning OFF the carrier developer supply roller 22 (S7). Then, the supply cycle $Y_C$ is added to the supply timing value $M_Y$ (S8), and the sequence goes back to S1. As a result, the supply timing value $M_Y$ becomes an accumulated number of copies update to be supplied next.

By repeating the above control, whenever a copying process is carried out $Y_C$ times, the carrier developer supply roller 22 is driven for a predetermined time, and additional carrier developer is supplied to the developer vessel 16 according to the driving time of the carrier developer supply roller 22.

When additional carrier developer is supplied to the developer vessel 16, the quantity of developer material gradually increases. However, because the discharge opening 26 is provided on the side wall 16*b* of the developer vessel 16, an excessive developer material which overflows is removed out of the developer vessel 16 and is collected in the waste container 23. As described, by repeating the supply of additional carrier developer and the discharge of excessive developer material to and from the developer vessel 16, excessive developer material in the developer vessel 16 can replace before the quality thereof deteriorates.

Figure 7:
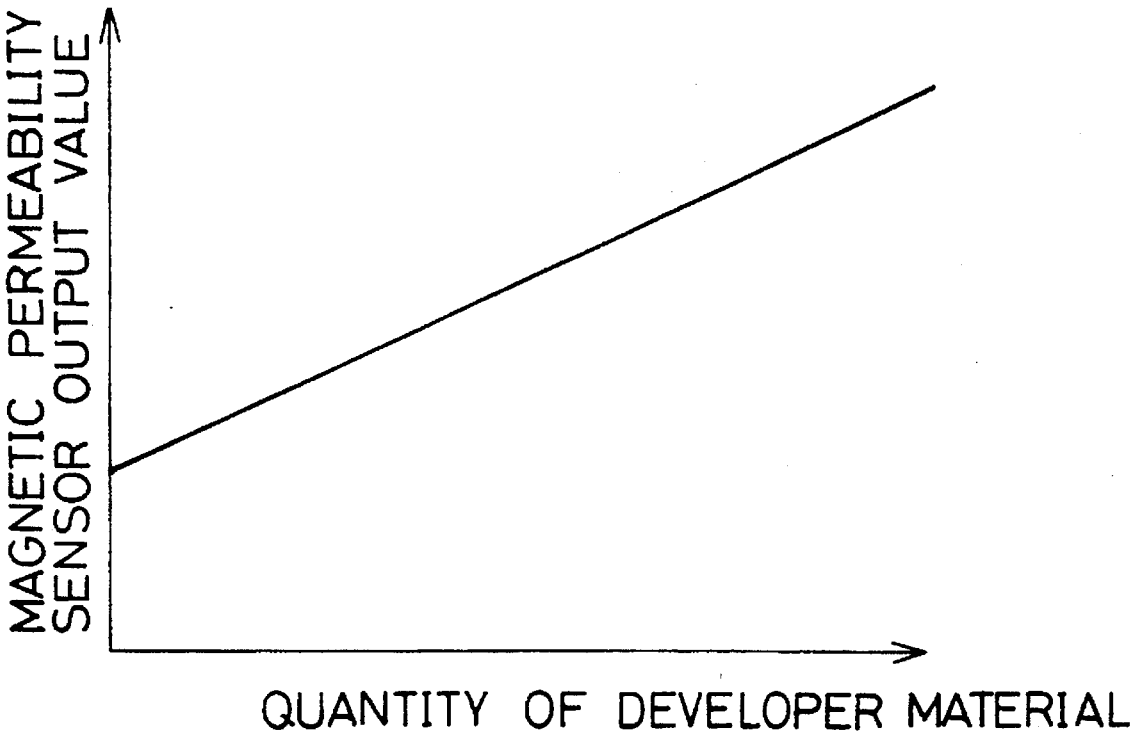
FIG. 7 is a graph showing an output value from a magnetic permeability sensor with respect to the quantity of the developer material.

FIG. 7 shows the relationship between the quantity of developer material and output value from the magnetic permeability sensor with respect to a ratio of toner particles. As can be seen from the figure, the quantity of developer material corresponds to the magnetic permeability output sensor one to one. Therefore, when the ratio of toner particles is constant, the quantity of the developer material can be detected using the output value from the magnetic permeability sensor.

Figure 8:
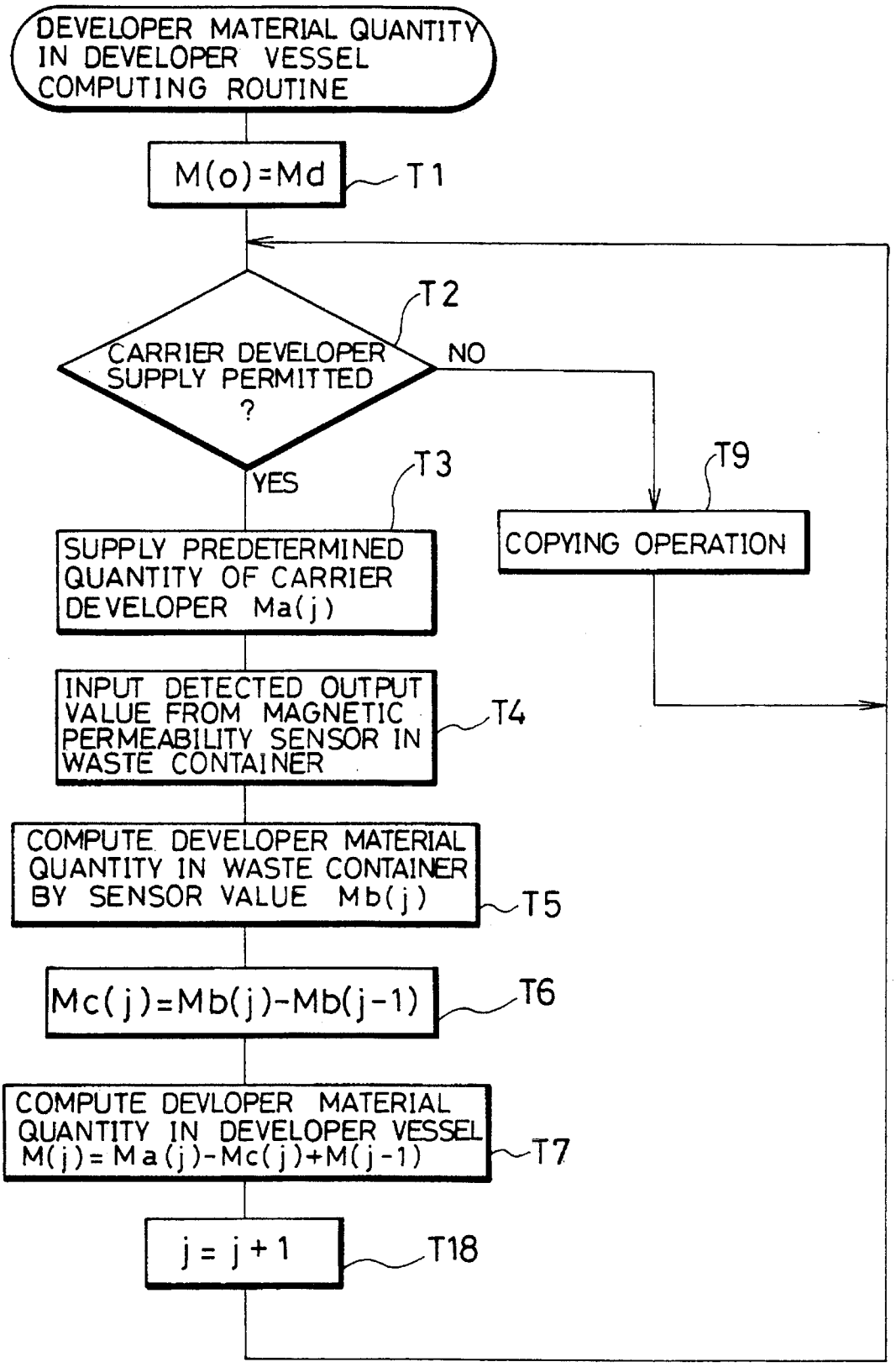
FIG. 8 is a flow chart showing the processes for computing the quantity of the developer material in the developer vessel.

Next, a method of controlling the quantity of the developer material in the developer vessel 16 will be explained in reference to the flow chart of FIG. 8.

First, the initial quantity of developer material Md to be kept in the developer vessel 16 is stored in the memory (T1). Next, it is determined whether the supply of additional carrier developer is permitted at this stage (T2). If not, a copying process continues (T9). If so in T2, the carrier developer supply roller 22 is driven for a predetermined time, and a predetermined quantity Ma(j) of carrier developer is supplied (T3). Then, an output value from the magnetic permeability sensor 24 (collecting section developer material quantity detection means) provided on the bottom of the waste container 23 is inputted to the control unit 32 (T4). Based on the inputted output value from the magnetic permeability sensor 24 to the control unit 32, the quantity of developer material Mb(j) in the waste container 23 is computed using the data table (T5). By taking the difference from the quantity of developer material Mb(j-1) in the waste container 23 which was collected last time, the quantity of developer material Mc(j) currently collected in the waste container 23 is derived (T6). The quantity of developer material M(j) in the developer vessel 16 is computed by the following equation (T7):

$$M(j)=Ma(j)-Mc(j)+M(j-1) \quad (1)$$

Then, the parameter i goes up by 1 (T8).

By repeating the above processes, the quantity of the developer material in the developer vessel 16 can be computed. Additionally, the data table used in computing Mb(j) is a table which shows the relationship between an output value from the magnetic permeability sensor 24 and the quantity of the developer material which have a predetermined relation therebetween for each ratio of toner particles. Here, the processes in T6 and T7 are carried out by the control unit 32.

Figure 9:
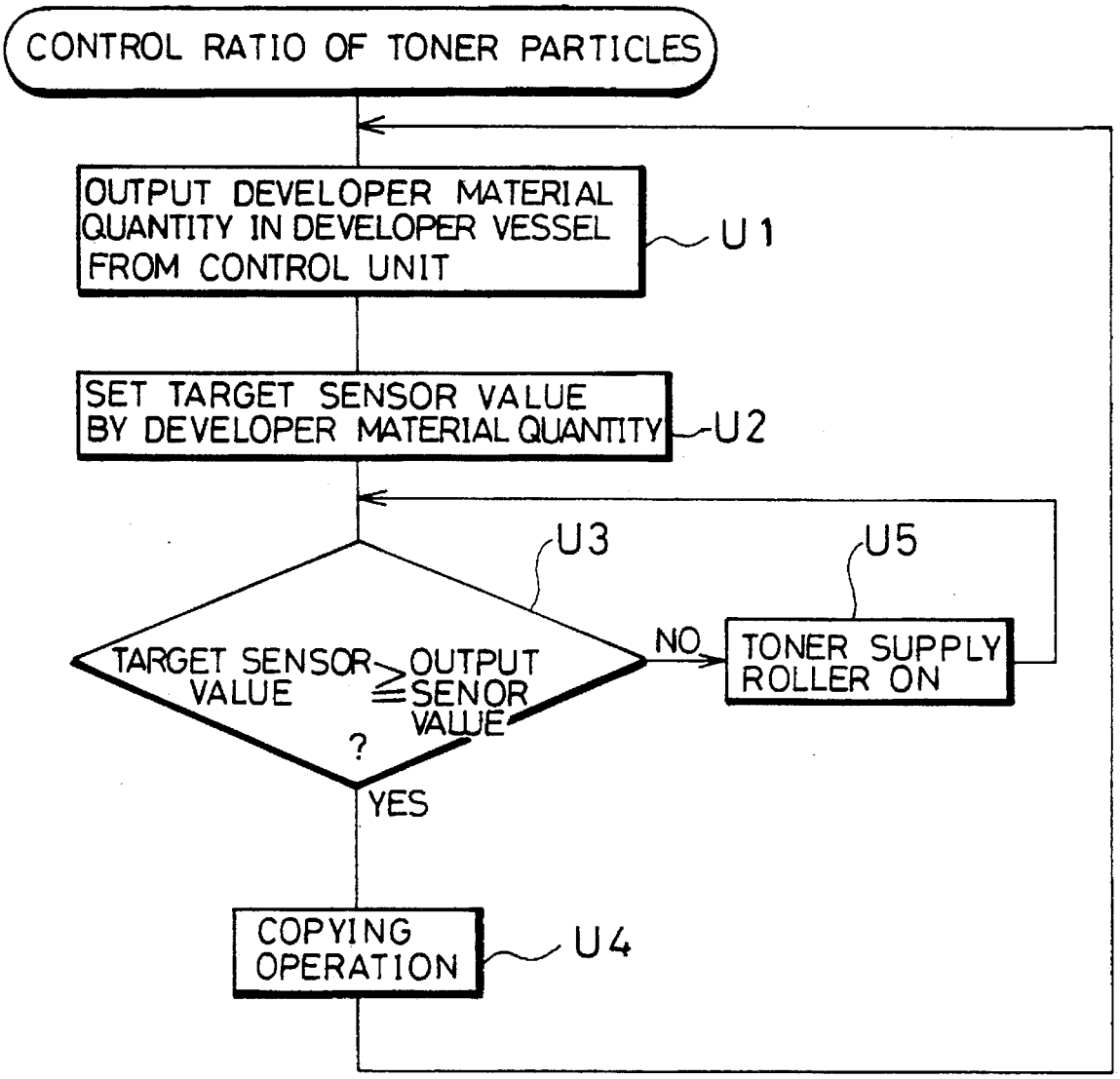
FIG. 9 is a flow chart showing the processes for controlling the ratio of toner particles.

In reference to FIG. 9, the processes for controlling the ratio of toner particles will be explained below. As shown in the flow chart of FIG. 8, the quantity of developer material in the developer vessel 16 is computed (U1). In the control unit 32, an output value from the magnetic permeability sensor (target ratio of toner particles) is set by the computed quantity of the developer material and a predetermined ratio of toner particles. Here, the relationship between the quantity of developer material and the output values from the magnetic permeability sensor (see FIG. 7) is used (U2). Then, the output value from the toner concentration sensor 25 is compared with the target output value from the magnetic permeability sensor (U3). When the output value from the toner concentration sensor 25 is greater than the target output value from the magnetic permeability sensor (i.e., when the detected ratio of toner particles in the developer vessel 16 is lower than the target ratio), because the ratio of carrier granules to the developer material is high, the toner supply roller 21 is activated so as to supply toner particles (U5). On the other hand, when the target output value from the magnetic permeability sensor is greater than the output value from the toner concentration sensor 25 (i.e., when the detected ratio of toner particles in the developer vessel 16 is higher than the target ratio), since the ratio of toner particles to the developer material is sufficient, a copying operation can be carried out (U4).

By repeating the above processes, the ratio of toner particles in the developer vessel 16 can be controlled at the target ratio. Additionally, the processes in U3 and U5 are carried out by the control unit 32 (control means).

In the above arrangement, based on an output value from the magnetic permeability sensor 24, the quantity of the developer material in the developer vessel 16 is detected, and an appropriate output value from toner concentration sensor 25 (target ratio of toner particles) corresponding to the detected quantity of the developer material is computed by the control unit 32. The detected output value from the toner concentration sensor 25 provided in the developer vessel 16 is compared with the computed target output value from the toner concentration sensor 25. Then, based on the results of the above comparison, supply of additional, toner particles from the toner particle storing compartment **20*a* is controlled by controlling the supply and the stoppage of the supply of the toner particles from the toner particle storing compartment 20*a*, thereby controlling the ratio of toner particles in the developer vessel 16**.

As described, the developer device 8 is arranged such that the toner particles and the carrier developer are additionally supplied, and excessive developer material is discharged. In such a device, even if the quantity of the developer material in the developer vessel 16 changes, the ratio of toner particles can be controlled within a negligible variation range. Furthermore, even if a large quantity of developer material is discharged from the developer vessel 16 at one time due to an impact or tilt when moving the copying machine provided with the developer device 8 of the present invention, the quantity of developer material in the developer vessel 16 can be accurately detected, and the ratio of toner particles can be controlled according to the detected quantity of the developer material. As a result, a constant ratio of toner particles can be surely maintained without having a broad variation range.

Next, another method for controlling the ratio of toner particles by computing the quantity of the developer material in the developer vessel 16 will be explained in reference to FIG. 10 through FIG. 12. For the sake of convenience, members having the same functions as in the aforementioned embodiment will be designated by the same codes and their descriptions shall be omitted.

Figure 10:
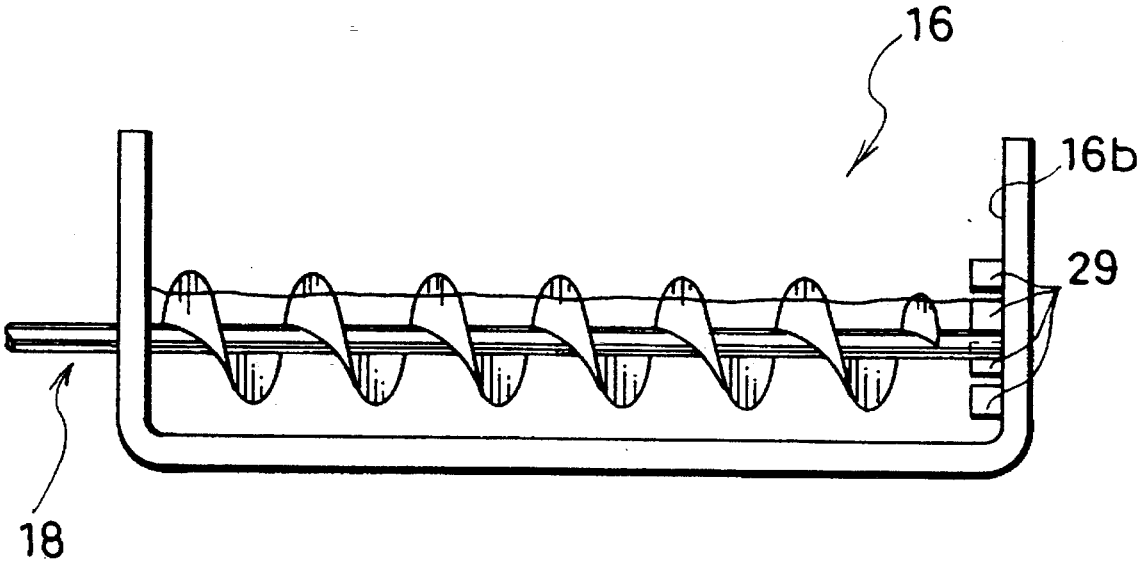
FIG. 10 which shows another embodiment of the present invention is an explanatory view showing an optical sensor provided in the developer vessel.

As shown in FIG. 10, a plurality of optical sensors 29 (developer material quantity detection means) are provided on the side wall of the developer vessel 16 from the bottom **16*d*** in the height direction so as to be adjacent one another.

Figure 11:
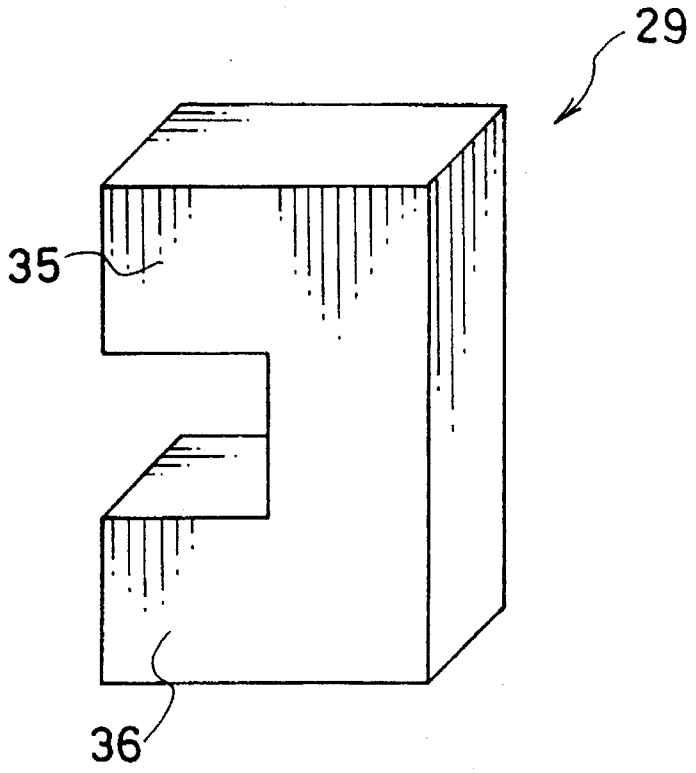
FIG. 11 is a perspective view schematically showing the optical sensor of FIG. 10.
Figure 12:
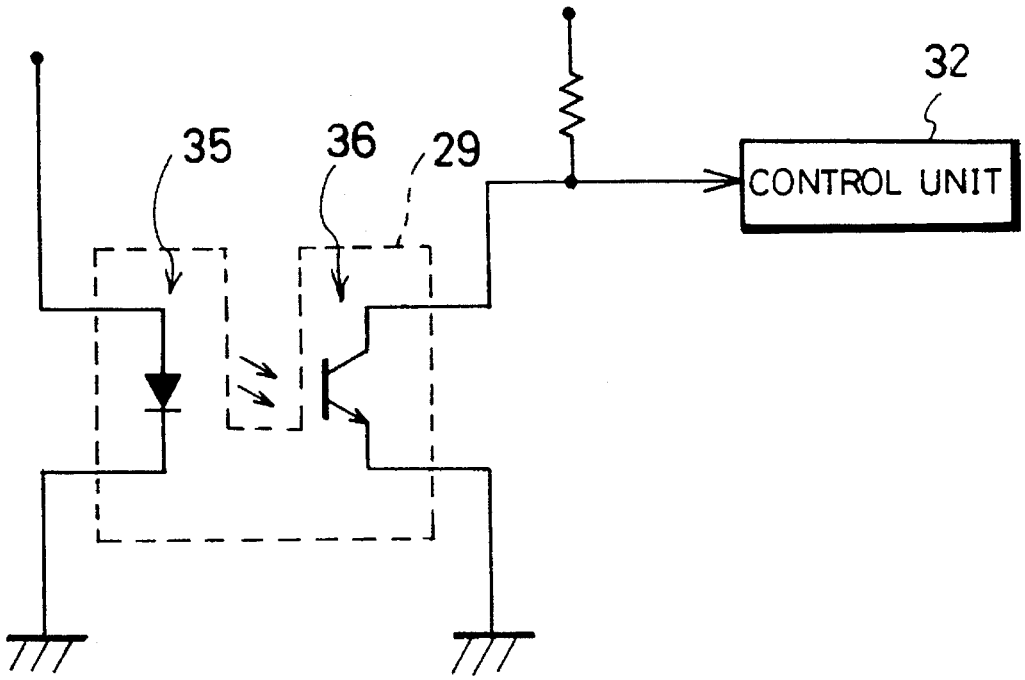
FIG. 12 is a circuit diagram showing the optical sensor of FIG. 10.

As shown in FIG. 11, the optical sensor 29 includes a light emitting element 35 from which light is emitted and a light receiving element 36 on which light is incident. As shown in FIG. 12, when light emitted from the light emitting element 35 reaches the light receiving element 36, the light receiving element 36 is set ON, and a LOW level signal is inputted to the control unit 32. On the other hand, when light emitted from the light emitting element 35 has not reached the light receiving element 36, the light receiving element 36 is set OFF, and a HIGH level signal is inputted to the control unit 32.

In the above arrangement, when a developer material exists between the light emitting element 35 and the light receiving element 36, the light receiving element 36 does not receive light emitted from the light emitting element 35, and a HIGH level signal is inputted to the control unit 32. Specifically, when the developer material is at a certain height, since the developer material is supplied between the light emitting element 35 and the light receiving element 36, the light emitted from the light emitting element 35 does not reach the light receiving element 36. On the other hand, when the optical sensor 29 is provided above the height of the developer material, the developer material is not supplied between the light emitting element 35 and the light receiving element 36. Therefore, the light emitted from the light emitting element 35 reaches the light receiving element 36. By a plurality of optical sensors provided within the developer vessel 16 in the height direction so as to be adjacent one another, the height of the developer material in the developer vessel 16 can be detected, thereby detecting the quantity of the developer material by the position where an input signal of the control unit 32 changes from HIGH level to LOW level.

Using the obtained quantity of the developer material in the developer vessel 16, an appropriate target ratio of toner particles for the quantity of the developer material is computed in the control unit 32 as in the case of the previous example. Then, the ratio of toner particles detected by the toner concentration sensor 25 provided in the developer vessel 16 is compared with the computed target ratio of toner particles. Then, the quantity of the toner particles to be supplied from the toner particle storing compartment 20*a* is controlled, thereby controlling the ratio of toner particles in the developer vessel 16. Here, the larger the number of the optical sensors 29 provided is, the more precise the detected quantity of the developer material is.

Additionally, the height of the developer material is set at a position where the input signal of the control unit 32 changes from HIGH level to LOW level. However, the present invention is not limited to the above arrangement. For example, it may be provided at a position where the signal to be inputted changes from LOW level to HIGH level. Similarly, the light receiving element 36 may be set OFF when it receives light.

In the above arrangement, the quantity of the developer material in the developer vessel 16 is detected by a plurality of optical sensors 29 provided in the developer vessel 16. Therefore, the ratio of toner particles is controlled based on the quantity of the developer material as in the case of the previous example. As a result, irrespectively of a change in the quantity of the developer material, the ratio of toner particles can be controlled within a negligible variation range.

As described, the developer device of the present embodiment includes: means for detecting the quantity of the developer material stored in the developer vessel; means for computing a target ratio of toner particles appropriate for the detected quantity of the developer material; means for additionally supplying toner particles to the developer vessel; and control means for controlling the ratio of toner particles to the developer material by controlling the quantity of toner particles to be additionally supplied based on a target ratio of toner particles and a detected ratio of toner particles. In the above arrangement, an appropriate output value from the toner concentration sensor can be computed based on the quantity of the developer material irrespectively of a change in the quantity of the developer material in the developer vessel. This permits the ratio of toner particles in the developer vessel to be easily controlled. As a result, the developer material in the developer vessel can be always maintained in an appropriate ratio, thereby ensuring a desirable image quality.

There are described above novel features which the skilled man will appreciate give rise to advantages. These are each independent aspects of the invention to be covered by the present application, irrespective of whether or not they are included within the scope of the following claims.

What is claimed is:

1. A developer device comprising:

a developer vessel for storing developer material composed of toner particles and carrier granules;

developer material concentration detection means for detecting a mixed ratio of toner particles and carrier granules;

developer material supply means for supplying the developer material into said developer vessel;

developer material quantity detection means for detecting an amount of the developer material, the developer material amount indicating summation of an amount of the toner particles and an amount of the carrier granules in the developer vessel; and control means for controlling the developer material supply means in accordance with the detected developer material amount so that the detected mixed ratio of the toner particles and carrier granules substantially equals to a target mixed ratio.

2. The developer device as set forth in claim 1, wherein said developer material quantity detection means includes a plurality of height detection means, provided in a height direction of the developer vessel, for respectively detecting a height from a bottom of the developer vessel so that the height of the developer material is detected in accordance with heights detected by the respective height detection means.

3. The developer device as set forth in claim 2, wherein the height detection means is an optical detector composed of a light emitting element and a light receiving element.

4. A developer device comprising:

a developer vessel for storing therein a quantity of a developer material composed of toner particles;

toner concentration detection means for detecting a ratio of toner particles in said developer vessel;

toner particle supply means for supplying an additional quantity of toner particles in said developer vessel;

a discharge section for discharging therethrough an excessive developer material, said discharge section being provided in said developer vessel;

a developer material collecting section for storing therein discharged excessive developer material, said developer material collecting section being provided so as to communicate with said discharge section;

excessive developer material quantity detection means for detecting a quantity of the discharged excessive developer material; and control means for computing a quantity of the developer material in said developer vessel in accordance with the discharged excessive developer material and the supplied developer material, and for computing a target concentration of toner particles corresponding to the computed quantity of developer material and for controlling the quantity of toner particles of the toner particle supply means so that the detected concentration of the toner particles is substantially equal to the target concentration of toner particles.

5. The developer device as set forth in claim 4, wherein said excessive developer material quantity detection means includes a magnetic permeability sensor.

6. The developer device as set forth in claim 4, wherein said developer material collecting section and said excessive developer material quantity detection means are provided so as to be mutually detachable.

7. The developer device as set forth in claim 4, wherein said toner concentration detection means is provided in a vicinity under said discharge section.

8. The developer device as set forth in claim 4, wherein said developer device has a lower portion, a developer material path is formed on the lower portion of said developer vessel for flowing therethrough the developer material in said developer vessel, and said toner concentration detection means is provided along said developer material path.

9. A developer device comprising:

a photoreceptor;

a developer vessel for storing therein a developer material composed of toner particles and carrier granules;

a stirring roller for stirring the developer material in said developer vessel, said stirring roller being provided so as to be freely rotatable;

a developer roller for supplying the developer material onto said photoreceptor, said developer roller being provided so as to be freely rotatable;

toner concentration detection means for detecting a ratio of toner particles in said developer vessel;

a discharge section for discharging therethrough an excessive developer material, said discharge section being provided in said developer vessel;

a developer material collecting section for storing therein a quantity of discharged excessive developer material, said developer material collecting section being provided so as to communicate with said discharge section;

toner particle supply means for supplying additional toner particles to said developer vessel;

developer material quantity detection means for detecting a quantity of the developer material stored in said developer vessel;

means for computing a target ratio of toner particles based on a detected quantity of the developer material; and control means for controlling a quantity of toner particles to be additionally supplied from said toner supply means so as to set a detected ratio of toner particles in said developer vessel equal to the target ratio.

10. The developer device as set forth in claim 9, wherein said developer material quantity detection means includes:

a magnetic permeability sensor for detecting a magnetic permeability of the developer material in the developer material collecting section;

collecting section developer material detection means for detecting the quantity of the developer material stored in said developer material collecting section based on the output from said magnetic permeability sensor; and developer material quantity computing means for computing the quantity of the developer material stored in said developer vessel based on the quantity of the developer material stored in said developer material collecting section.

11. The developer device as set forth in claim 9, wherein the developer material quantity detection means provided in said developer vessel include a plurality of height detection means provided in a height direction of the developer vessel, for respectively detecting a height from a bottom of the developer vessel so that the height of the developer material is detected in accordance with the heights detected by the respective height detection means.

12. The developer device as set forth in claim 11, wherein said means for detecting the height of the developer material stored in said developer vessel is an optical detector composed of a light emitting element and a light receiving element.

13. The developer device as set forth in claim 10, wherein said developer material collecting section and said collecting section developer material detection means are provided so as to be mutually detachable.

14. The developer device as set forth in claim 10, wherein said magnetic permeability sensor is provided on a bottom of said developer material collecting section.

15. The developer device as set forth in claim 10, said developer material quantity computing means computes a quantity of the developer material based on a data table for storing therein data regarding the quantity of the developer material and an output from the magnetic permeability sensor which have a predetermined relation therebetween for each ratio of toner particles.

16. The developer device as set forth in claim 13, wherein said developer vessel comprises a bottom, a plurality of side walls and a discharge side wherein said discharge section is provided on a side wall of the developer vessel, said developer device further comprising:

a support member for supporting said developer material collecting section, said support member being provided at the bottom of said developer vessel on the discharge side, and said magnetic permeability sensor is provided in said support member.

17. The developer device as set forth in claim 16, wherein:

a collection-use opening section is provided on a side wall of the developer material collecting section for communicating with said discharge section, a projected section is provided under the collection-use opening section for preventing the developer material from spilling;

a recessed portion is formed on the bottom of the developer material collecting section, which accommodates with a projected portion formed on the bottom of said developer vessel; and there is a hole for installing said magnetic permeability sensor on the bottom of said developer vessel.

18. The developer device as set forth in claim 17, further comprising an opening and closing mechanism for opening and closing the collection-use opening, said opening and closing mechanism including:

an opening and closing plate-shaped cover provided so as to be freely siding along an outer surface of the side wall of said developer vessel;

a guide plate for guiding a sliding of said opening an closing cover, said guide plate being provided on both sides of said opening and closing cover; and a discharge-use solenoid with a leading end of a plunger thereof being connected to said opening and closing cover.

19. The developer device comprising:

a photoreceptor;

a developer vessel for storing therein a developer material composed of toner particles and carrier granules, said developer vessel comprising a bottom and a plurality of side walls;

developer material supply means for supplying the developer material to the developer vessel;

a developer material discharge opening in a side wall of the developer vessel;

a stirring roller for stirring the developer material, said stirring roller being provided so as to be freely rotatable;

a developer roller for supplying the developer material onto said photoreceptor, said developer roller being provided so as to be freely rotatable;

a carrier supply section for supplying a carrier developer including carrier granules to said developer vessel;

a toner concentration sensor provided in a vicinity under the discharge opening;

wherein the developer material in said developer vessel is discharged through said discharge opening, and the developer material is supplied in said developer vessel based on a ratio of the toner particles to the developer material in said developer vessel detected by said toner concentration sensor.

20. A developer device comprising:

a photoreceptor;

a developer vessel for storing therein a developer material composed of toner particles and carrier granules, said developer vessel comprising a bottom and a plurality of side walls;

a developer material discharge opening in a side wall of the developer vessel;

a stirring roller for stirring the developer material, said stirring roller being provided so as to be freely rotatable;

a developer roller for supplying the developer material onto said photoreceptor, said developer roller being provided so as to be freely rotatable;

a carrier supply section for supplying a carrier developer including carrier granules to said developer vessel;

a toner supply section for supplying toner to said developer vessel;

a developer material path for flowing therethrough the developer material in said developer vessel is formed in a lower portion of said developer vessel; and a toner concentration sensor provided along said developer material path;

wherein the developer material stored in said developer vessel is discharged from the discharge opening, whereas, additional toner particles are supplied from the toner supply section to the developer vessel based on a ratio of the toner particles to the developer material in said developer vessel detected by said toner concentration sensor.

* * * * *